United States Patent [19]

Wisbey et al.

[11] Patent Number: 4,593,231

[45] Date of Patent: Jun. 3, 1986

[54] THREE-WAY FLUORESCENT LAMP DEVICE

[75] Inventors: Robert W. Wisbey, Arlington Heights; Joseph S. Droho, Chicago, both of Ill.

[73] Assignee: Advance Transformer Co., Chicago, Ill.

[21] Appl. No.: 598,521

[22] Filed: Apr. 9, 1984

[51] Int. Cl.[4] ..... H05B 39/00

[52] U.S. Cl. ..... 315/100; 315/72; 315/102; 315/104; 315/290; 315/DIG. 5

[58] Field of Search ..... 338/20; 315/100, 102, 315/104, 99, 72, DIG. 4, DIG. 5, 99

[56] References Cited

U.S. PATENT DOCUMENTS

| | | | |
|---|---|---|---|
| 2,278,256 | 3/1942 | Frech | 315/100 |
| 2,735,961 | 2/1956 | Hamilton | 315/104 |
| 3,975,660 | 8/1976 | Knobel et al. | 315/102 |
| 4,348,612 | 9/1982 | Morton | 315/72 |
| 4,349,768 | 9/1982 | Miller | 315/105 |

*Primary Examiner*—Harold A. Dixon

*Attorney, Agent, or Firm*—Silverman, Cass & Singer

[57] ABSTRACT

A ballast circuit for starting and operating a preheat type circular fluorescent lamp, which replaces a multiple wattage incandescent lamp in a three-way incandescent lamp socket, so that the fluorescent lamp can be ignited to function at three different operating wattages. A lamination stacked core structure mounts first and second coils. A passive circuit element, such as positive temperature coefficient resistor also known as a thermistor, is connected in the circuit, which includes a three-way incandescent lamp screw base, for current switching functions to achieve the desired ignition and operating currents for the fluorescent lamp at its different operating wattages.

59 Claims, 7 Drawing Figures

THREE-WAY FLUORESCENT LAMP DEVICE

BACKGROUND OF THE INVENTION

This invention relates generally to fluorescent lighting devices, and in particular, relates to such devices capable of providing three levels of light when energized from a three-way incandescent lamp socket.

Fluorescent lamp devices replacing single wattage incandescent lamps are known and achieve substantial operating economy over the incandescent lamps they replace. They generally comprise a fluorescent lamp, usually arranged in a major portion of a circle, having preheatable cathode filaments in each end and a line voltage starter circuit connected across the two filaments to start the lamp. One end of the lamp is connected directly to the shell of a standard, screw-in, incandescent lamp base. The other end is connected to the base pin by a choke, such as a reactor or an inductor, which serves to limit or ballast the operating current of the negative resistance fluorescent lamp. The choke is constructed and arranged to pass sufficient current to the preheat filaments to insure proper lamp starting and limit the operating current to below the maximum lamp operating current. In actuality, the preheat filament current necessary to raise the filaments to a sufficiently high temperature for proper lamp starting is similar to or greater than the lamp operating current. This is generally for the fixed wattage replacement device operating at a fixed light level, which is equivalent to the light level produced by the replaced incandescent lamp.

Flurorescent lamp devices replacing multiple wattage, such as three-way, incandescent lamps also are known, but until now have failed to achieve the light levels produced by the replaced incandescent lamps, particularly in the "LOW" and "MEDIUM" (hereafter "MED") modes of operation. Popular incandescent three-way lamps have wattage ratings of 30/70/100 and 50/200/250, the numbers respectively indicating the LOW, MED and HIGH operating wattages. The light level produced in each mode is directly related to the wattage so that a 30/70/100 watt incandescent lamp produces light levels of respectively, approximately 30%, 70% and 100% of the maximum or HIGH light level.

A typical three-way fluorescent lamp device, exemplified by the devices described in U.S. Pat. Nos. 4,349,768 and 4,178,535 to Miller, connects one end of the fluorescent lamp to the shell of a standard, screw-in, three-way incandescent lamp base. The other end is connected by a first series choke of a high reactance value to the center pin of the base or plug and by a second, series choke of a low reactance value to the ring of the base. In the LOW mode, current flows through the pin, first choke, lamp and base shell. In the MED mode, current flows through the ring, second choke, lamp and plug. In the HIGH mode, current flows through the pin and ring, both chokes in parallel, the lamp and the base shell. The LOW and MED light levels thus are provided by the independent action of such dual first and second chokes, while the HIGH light level is provided by the parallel action of the first and second dual chokes.

The high reactance value of the first choke limits the fluorescent lamp operating current to a low level, which, in turn, determines the LOW light level produced by the lamp. The low reactance value of the second choke passes a higher lamp operating current, determining the MED level of light produced by the lamp. The parallel reactance of the first and second chokes passes a still higher current, determining the HIGH light level. The lamp operating current in the HIGH mode may be greater than the sum of the currents in the LOW and MED modes due to the negative resistance characteristics of the fluorescent lamp.

The known three-way fluorescent replacement lamp devices, however, have been unable to achieve LOW light levels less than about 50–60% of the HIGH light levels. The problem is inexpensively providing sufficient lamp preheat filament current for proper starting while limiting LOW mode operating current to a substantially lesser current. This problem has been skirted by limiting the LOW mode operating current to produce a LOW light level of about 45% of the HIGH level. The MED mode light level then is set at about 55% of the HIGH level, and by careful selection of the choke reactance values, proper starting is insured. The small percentage light level in the LOW mode, however, is not achieved.

Alternatively, the 50% limitation has been avoided by over driving the fluorescent lamp in the HIGH mode; providing for lower percentage LOW mode light levels, but reducing lamp life.

It is known to use a positive temperature coefficient (PTC) resistor or thermistor in a fluorescent lamp device replacing a three-way incandescent lamp, see U.S. Pat. No. 4,386,296. The device described there, however, produces only two light levels: LOW and HIGH. The circuit of that device uses only one choke, which passes current for both modes of operation and includes a thermistor which operates to produce the LOW mode light level. Essentially, the choke is connected between the base ring and the second end of the fluorescent lamp. The thermistor is connected between the base pin and the end of the choke connected to the base ring. When power first is applied in the LOW mode to the pin, the thermistor is of low resistance and passes sufficient current through the choke and preheat filaments to start the lamp. Shortly thereafter, the thermistor temperature, and therefrom, resistance increases to limit the operating current to the desired LOW light level. Two disadvantages of this device are the limited number of light levels and the use of the thermistor as a current limiting and energy wasting device. A waiting period must pass before the thermistor cools sufficiently to pass enough current to the preheat filaments for restarting the lamp in the LOW mode.

What is desired, then, is a fluorescent lamp device capable of providing the three light levels realized from a three-way incandescent lamp. In such a device, in the LOW and MED modes of operation, both sufficient preheat filament current must be available for proper starting, and the light level percentages should be similar to those of the comparable incandescent lamp. Further the device should exhibit little or no time delay in starting the fluorescent lamp in any mode.

SUMMARY OF THE INVENTION

The device of the invention achieves the advantages of a dual choke ballast circuit in which a first choke ballasts the lamp in the LOW mode, a second choke ballasts the lamp in the MED mode, and the parallel combination of both chokes ballast the lamp in the HIGH mode.

In accordance with the invention, the fluorescent lamp device comprises a passive electrical component connected in the ballast circuit of the device. This component, which may be a thermistor, a bi-metal switch in series with any necessary fixed impedance, or other suitable electrical means, operates as a switch first, momentarily to pass a large starting current to the preheatable filaments of the lamp, and then after the lamp ignites or starts to switch operating current through the appropriate ballast circuit, albeit not through said component, properly limited for operating the lamp.

In one embodiment of the invention, a positive temperature coefficient (PTC) resistor or thermistor is connected across the terminals of the first and second chokes that, respectively, are connected to the pin and ring of the three-way socket. In this circuit configuration, when power is first applied to either the pin or ring of the socket, the thermistor causes starting current sufficient to start the lamp to pass in parallel through both chokes to the lamp. After a short period, the thermistor increases in temperature and thereby, resistance, to cause operating current to flow only through the choke associated with the pin or ring to which power is applied. In the starting state then, the thermistor switches the chokes in parallel, passing a large starting current to the lamp preheat filaments. In the running state, the thermistor switches the operating current through the proper choke and plays no part in the operating circuit.

In a second embodiment of the invention, the thermistor is connected in parallel across the terminals of the first choke from the pin to the other end of the lamp. When power first is applied to the pin of the base, the thermistor is cool and of low resistance, and therefore the parallel combination of the thermistor and first choke passes sufficient starting current to start the lamp. A short period thereafter the temperature and resistance of the thermistor increases forcing the operating current of the LOW mode to pass substantially only through the first choke. In the starting state, then, the thermistor operates as a switch shunting a portion of the starting current around the choke. In the operating state, the thermistor switches all the operating current through the first choke and plays no further part in the operation of the device.

In a third embodiment of the invention, there are two thermistors. One thermistor is connected in parallel across the terminals of the first choke from the pin to the other end of the lamp. The other thermistor is connected in parallel across the terminals of the second choke from the ring to the other end of the lamp. This is for the case in which the chokes respectively limit the LOW and MED mode operating currents to values below the levels required for lamp starting. When power first is applied to the pin or ring of the base, the associated thermistor is cool and of low resistance. The parallel combination of the appropriate thermistor and choke passes sufficient starting current to start the lamp. A short period thereafter the temperature and resistance of the thermistor increases forcing the operating current to pass substantially only through the associated choke. Similar to the second embodiment, in the starting state the thermistor operates as a switch shunting a portion of the starting current around the associated choke; and in the operating state the thermistor switches all the operating current through the associated choke and plays no further part in the operation of the device.

The invention also includes a single ballast means comprising a single magnetic core structure which mounts two coils for achieving the ballast functions of the two separate chokes taught by the prior art. The structure comprises an "E" shaped or three legged core and an "I" shaped end piece. The coils are mounted on the end legs of the core and the magnetic flux induced in the core by each coil passes in a loop through the associated end leg and the center leg, the center leg being common to both loops. The coils can be arranged to produce magnetic flux polarities in the center leg that oppose one another, resulting in a small magnetic flux in the center leg when both coils are energized. The center leg then can be dimensioned to be no larger than necessary to carry the magnetic flux induced by either coil and can be equal to or less than the cross-sectional area of either of the two end legs. Current passing through either coil, and the magnetic flux induced thereby, thus is essentially independent of any current passing through the other coil, and the magnetic flux induced thereby, and this occurs on a common magnetic flux carrying structure.

DESCRIPTION OF THE PREFERRED EMBODIMENT

The invention will be understood best by considering that in the prior fluorescent lamp devices providing multiple light levels, passive circuit elements, such as resistors and thermistors, were connected in series between the pin of the base and the lamp. They thus carried the lamp starting current and acted as a portion of the LOW mode ballast by carrying and limiting the LOW mode operating current. In the invention, a passive circuit element, i.e., a thermistor, is in series with the lamp and carries appreciable current during only the starting state. Thereafter, the passive circuit element plays no part in carrying the lamp operating current and a conventional choke or other ballast means limits the lamp operating current. Because of the role played by the passive circuit element, which also can include a temperature sensitive bi-metal switch, the invention can be considered as providing a switch passing sufficient lamp starting current, or at least a part of it, during the starting of the lamp and later switching the lamp operating current through the appropriate choke. The portion of the starting current carried by the passive circuit element is the difference between the operating current carried by the associated choke or ballast means and the total starting current.

The advantages of the invention are apparent. An inexpensive, small, passive circuit element is arranged to carry a portion of the switch starting current to the lamp. The passive circuit element can be less robust than the thermistors of the previous devices because it need carry only a portion of the starting current, and then only for a short time. Thereafter, it takes a high resistance value and plays substantially no part in the operating circuit. The associated choke carrying lamp operating current can have any reactance value from a large range, because, effectively, it is not required to pass all of the starting current for the lamp.

This also results in advantages in the structure of the two chokes. Because of the incorporation of the passive circuit element, the chokes do not have to be specially designed to carry first starting current and then a different operating current, and can be simply constructed and arranged. Moreover, the invention contemplates a single ballast that has one magnetic core structure mounting two coils thereon, and yet provides for independent operation of the currents passing through the coils. The advantages of such a structure are economy of volume, weight and number of parts.

Figure 1:
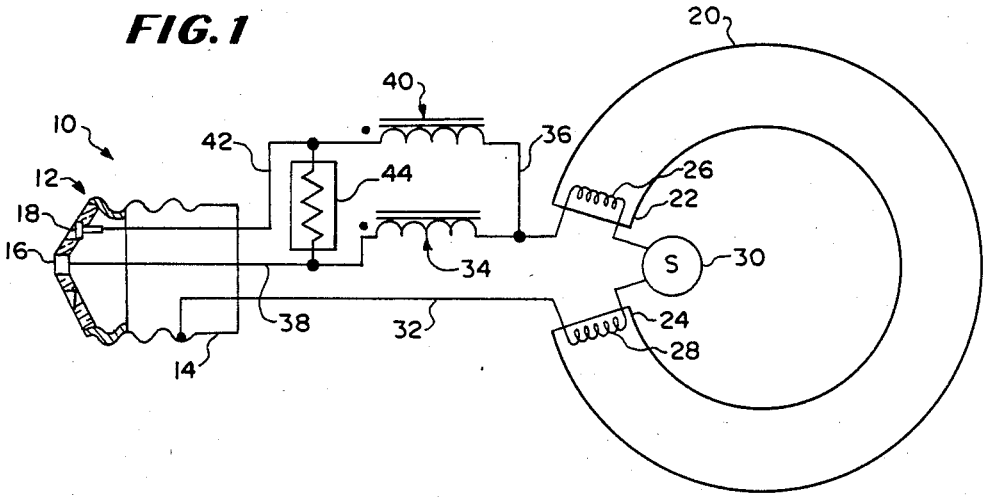
FIG. 1 is a schematic diagram of a fluorescent lamp device providing standard three-way operation constructed and arranged according to the invention.
Figure 2:
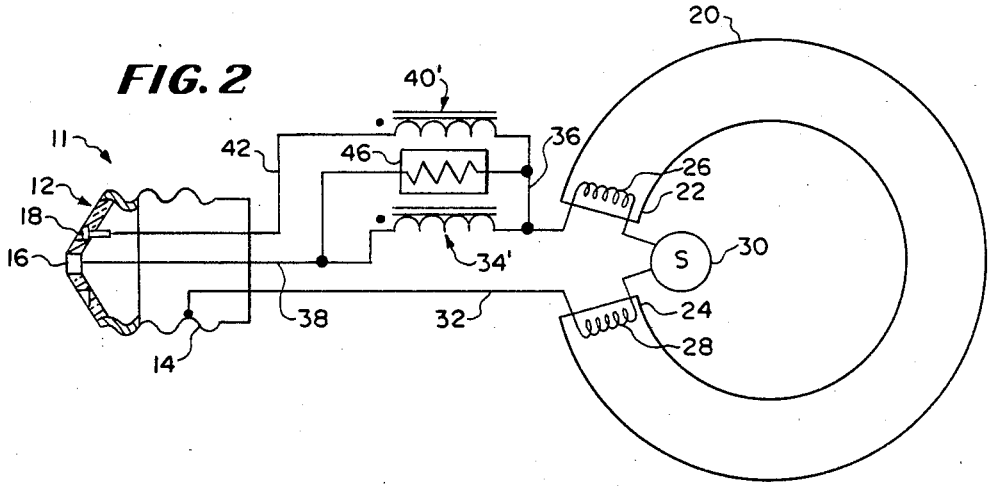
FIG. 2 illustrates a second embodiment of the invention.
Figure 3:
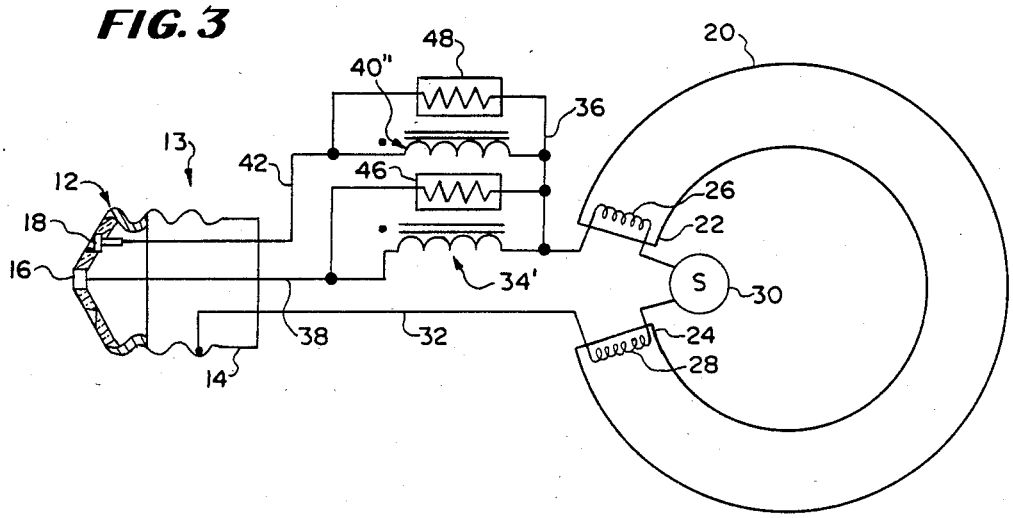
FIG. 3 illustrates a third embodiment of the invention.

Referring to FIGS. 1, 2 and 3, three fluorescent lamp devices embodying the invention are indicated generally by the reference characters 10, 11 and 13, respectively. Like reference numerals are employed to identify like structural elements of the devices. The devices each comprise a standard, screw-in, three-way incandescent lamp base 12 having a shell 14, a pin 16 and a ring 18. Fluorescent lamp 20 is arranged in the major portion of a circle, also known as a Circline lamp, and has two proximate ends 22 and 24. Lamp 20 has a preheatable cathode filament 26 and 28 in each of ends 22 and 24. A conventional, commercially available, line voltage starter 30 connects the filaments in series. During the starting state, starter 30 acts as a short circuit allowing full starting current to pass through the filaments in series to elevate the temperature thereof by resistive heating. After the lamp ignites, which typically takes 1–2 seconds, the starter creates an open circuit condition causing the lamp operating current to pass only through the lamp 20. Lamp 20 is of the type known as a gaseous or gas discharge lamp that is suitable for starting and operating on line voltage. Lamp 20 can have a configuration other than the major portion of a circle, and starter 30 can be other than specifically described.

The filament 28 in the one end 24 of the lamp 20 is directly connected to the shell 14 by a lead 32. A first choke 34 connects filament 26 in the other end 22 of the lamp to the pin 16 by way of leads 36 and 38. A second choke 40 connects the filament 26 in the other end 22 of the lamp to the ring 18 by way of leads 36 and 42.

A passive circuit component, such as a thermistor 44 shown in FIG. 1, connects the lead 38 to the lead 42, effectively bridging the pin 16 and the ring 18 or the base side terminals of both chokes 34 and 40.

In FIG. 2, thermistor 46 connects the lead 36 to the lead 38, effectively bridging or being connected in parallel with the terminals of choke 34.

In FIG. 3, thermistor 46 is connected as shown in FIG. 2 and additionally, thermistor 48 connects lead 36 to lead 42, effectively bridging or being connected in parallel with the terminals of choke 40.

Thermistors 44, 46 and 48 are selected to have characteristics suitable for their respective circuit and are separately identified to avoid confusion in the description. Thermistors 44, 46 and 48 essentially are resistors and therefore are encompassed by the phrase "passive circuit element". This is distinguished from an active circuit element, such as a transistor, that is acted upon by an external force to affect the operation of the circuit. Thermistors 44, 46 and 48 do not have fixed resistance values, but rather their resistance values vary with temperature. Thermistor 44 typically has a resistance value at room temperature of 50 ohms, a switching temperature of 120° C. and a high temperature resistance value of more than 20,000 ohms. Thermistor 46 typically has a resistance value at room temperature of 300 ohms and thermistor 48 typically has a resistance value at room temperature of 400 ohms. Both thermistor 46 and 48 have switching temperatures of 120° C. and a high temperature resistance value of more than 20,000 ohms. The temperature rise in thermistors 44, 46 and 48 results from the electrical power heating of current passing through the low resistance of the thermistor. Once they have been switched to their high resistance state by carrying a large current, a small trickle current is sufficient to maintain that state.

A three-way incandescent lamp socket (not shown) connected to an A.C. line power source, receives the base 12. Thus connected, electrical power is supplied across the shell and pin in the LOW mode, across the shell and ring in MED mode, and across the shell and the combination of the pin and ring in the HIGH mode. No electrical power is applied to the socket in the OFF mode switch position. The standard mode or switch sequence is OFF-LOW-MED-HIGH-OFF.

In FIG. 1, chokes 34 and 40 have reactance values desired for operating the lamp in the LOW and MED modes. Typically, the reactance of choke 34 will limit the lamp operating current passed therethrough to a value less than the starting current level required to start lamp 20, and the reactance of choke 40 will limit the lamp operating current passed therethrough to a value equal to or greater than the starting current level required to start lamp 20. The reactance values of both chokes could be reversed, however, if desired, and the reactance values of both chokes could be great enough to limit the operating currents passing therethrough to values less than the starting current level required to start the lamp. The only limitation on the reactances of chokes 34 and 40 in the configuration of FIG. 1 is that chokes 34 and 40, when connected in parallel, be able to pass a level of starting current sufficient to start lamp 20.

Generally, it is desired to activate the lamp by first energizing it in the LOW mode. In operation of device 10 of FIG. 1, when the lamp first is to be activated in the LOW mode, power is supplied across the shell 14 and pin 16. Current from pin 16 flows in parallel through choke 34 and the series combination of thermistor 44 and choke 40 to filament 26 and then through starter 30 and filament 28 to shell 14. This current flow path reverses itself every cycle of the alternating current (A.C.) line source, and the reversal of the paths in this and the other embodiments will be understood and not further described. The characteristically low resistance of thermistor 44, due to its being at an ambient room temperature, enables a portion of the lamp starting current to pass therethrough and through choke 40 to the lamp. The cold resistance of thermistor 44 and the reactances of chokes 34 and 40 are selected to pass a starting current to filaments 26 and 28 sufficient for starting the lamp.

A short period after the lamp is ignited, the temperature of thermistor 44 increases, due to resistive heating, so as to realize its switching function, thereby effectively stopping current flow through the thermistor 44 and choke 40. Up to this point, almost full HIGH mode operating current had been passed to the lamp by the parallel combination of chokes 34 and 40. Now, the operating current is limited or ballasted to that of the LOW mode by the reactance of choke 34 operating alone in series with the lamp. Thermistor 44 effectively plays no further part in operation of lamp 20, although a small trickle current still flows through thermistor 44 and choke 40 thereby maintaining thermistor 44 in equilibrium at a high resistance above the switching point.

Occasionally, it is desired to actuate the device 10 by first energizing it in the MED mode. Power is supplied across the shell 14 and ring 18 and current flows through the circuit in a similar way described for starting in the LOW mode. The series combination of thermistor 44 and choke 34 in parallel with choke 40 passes sufficient starting current. A short period after the lamp is ignited, the thermistor switches to its high resistance state forcing MED mode operating current through only choke 40. A trickle current through choke 34 maintains thermistor 44 in its high resistance state.

When energizing the device 10 in the HIGH mode, full HIGH mode current flows through the parallel combination of chokes 34 and 40 from pin 16 and ring 18. The resistance of thermistor 44 is superfluous to the operation of the circuit of device 10 and no current flows therethrough, allowing thermistor 44 to cool to ambient temperature. The thermistor 44, thus, becomes ready to aid in starting lamp 20 in either the LOW or MED modes.

In summary, in the embodiment of FIG. 1, the passive circuit element or means comprising thermistor 44 acts as a switch, switching lamp starting current from the pin 16 or ring 18 through the parallel combination of choke 34 and choke 40. This starts the lamp 20 quickly. The 50 ohm. cold resistance of thermistor 44 somewhat limits the current flowing through it and choke 34 or choke 40, but not to an extend adversely affecting lamp starting. When thermistor 44 increases in temperature to above its switching point, the current flowing through the lamp is forced to flow through the path of least resistance, namely choke 34 or choke 40. Operation is achieve automatically and with a reliable passive element.

The device 11 of FIG. 2 operative differently but still uses the passive circuit element to switch lamp starting current around the reactance of choke 34'.

Choke 34' has a high reactance selected to limit LOW mode operating current to a value less than the required starting current level. Choke 40' has a low reactance selected to limit MED mode operating current to a value equal to or greater than the required starting current level.

In first activating device 11 in the LOW mode, power is supplied across the pin 16 and shell 14. Starting current flows mainly through thermistor 46, now at ambient room temperture in parallel with choke 34' and then, through lamp filaments 26 and 28. The starting current flows mainly through thermistor 46 because its cold temperature resistance is substantially less than the high reactance of choke 34'. After a period long enough to guarantee lamp starting, the current flow through thermistor 46 heats the thermistor to the switching termperature, substantially increasing its temperature and stopping substantial current flow therethrough. The thermistor then effectively drops out of the circuit and plays no further role therein. LOW mode operating current is carried exclusively by high reactance choke 34'. Again, a trickle current through thermistor 46 maintains its resistance above the switching print.

When first activating device 11 in the MED mode, choke 40' supplies sufficient starting and operating current to the lamp 20. Thermistor 46 and choke 34' are by-passed in the MED mode starting or operation, and thermistor 46 begins cooling.

When energizing device 11 in the HIGH mode, sufficient lamp starting current is passed to the lamp 20 by the parallel combination of chokes 40' and 34'. Thermistor 46 remains in the high resistance condition and merely carries a trickle current.

The passive circuit element means comprising thermistor 46 of FIG. 2 then acts as a switch passing sufficient starting current to the filaments 26 and 28 to guarantee starting of the lamp. Thereafter, thermistor 46 is dormant functionally in the LOW mode operation. Thermistor 46 does not contribute to lamp starting or operation in the MED mode and functions inconsequentially in the HIGH mode, the chokes alone carrying adequate starting and operating current.

The device 13 of FIG. 3 operates similarly to device 11 but adds additional thermistor 48. Choke 40'' has a high reactance limiting MED Mode lamp operating current to a value less than the starting current level required for starting lamp 20. Choke 34' has the same high reactance value assigned to it in device 11.

When first activating device 13 in the LOW mode, operation is the same as for device 11. Thermistor 46 carries a large portion of the lamp starting current with the remainder passing through the choke 34'. After the starting period, thermistor 46 rises in temperature to the switching point, switching all operating current through choke 34' except for a trickle current through thermistor 46.

When first activating device 13 in the MED mode, sufficient lamp starting current flows mainly through thermistor 48, which is at ambient room temperature, in parallel with choke 40'', and then through filaments 26 and 28. The starting current flows mainly through thermistor 48 because its cold temperature resistance is substantially less than the high reactance of choke 40''. After a period guaranteeing lamp starting, the temperature and resistance of thermistor 48 increase due to resistive heating and stop substantial current flow therethrough. The thermistor then has no further substantial effect on the circuit. MED mode operating current is carried exclusively by choke 40'' with a trickle current maintaining thermistor 48 in the high resistance state.

When first activating device 13 in the HIGH mode, sufficient lamp starting current is passed to the lamp 20 by the parallel combination of the chokes 34' and 40'' with or without the further current passed by the parallel thermistors 46 and 48.

In normal switching from the LOW to MED modes, the conditions under which the lamp 20 is operating remain substantially constant so that the lamp re-ignites immediately upon application of the operating power of the MED mode. The operating conditions of the lamp 20 do not vary to an extent requiring recycling of the thermistor and starter. This is for all three devices 10, 11 and 13. The transition from the MED to HIGH modes presents no re-ignition problem because the HIGH mode operating current always exceeds the required starting current for the lamp.

Thermistors 44, 46 and 48, thus have been connected in the devices 10, 11 and 13 in parallel operating relationship to one or both of the chokes. The thermistors function as switches, switching a portion of the required lamp starting current to by-pass a choke, and, thereafter, switching lamp operating current through only said choke. The thermistors switch the starting current for a period sufficient to guarantee lamp ignition. The switching function is provided by the change in thermistor resistance from the ambient temperature, low resistance to the increased temperature and high resistance.

Thermistors having other values and characteristics can replace thermistors 44, 46 and 48 to operate in harmony with differently valued chokes 34 and 40 and lamps 20. Further, other passive circuit elements that include bi-mental switches that open at high temperatures or otherwise provide a time delay, can replace thermistors 44, 46 and 48 and yet embody the invention. The major requirement for such a passive circuit element is that it present a low resistance for a period, typically 5–15 seconds, which is greater than the typical starting time of a preheat fluorescent lamp to guarantee starting current flow for lamp ignition under varying conditions. Thereafter, the element should present a high resistance or open circuit to force a lamp operating current through the appropriate ballast choke, the passive element then playing little or no part in the device operating circuit.

Since the passive circuit element carries only part of the starting current for only a short period, and thereafter, carries little current, the element can be less robust and less expensive than other elements that must carry operating current for extended periods of lamp operation. This substantially reduces the cost of devices 10, 11 and 13 and contributes to improved reliability and life which are vital considerations for the consumer market.

Figure 4:
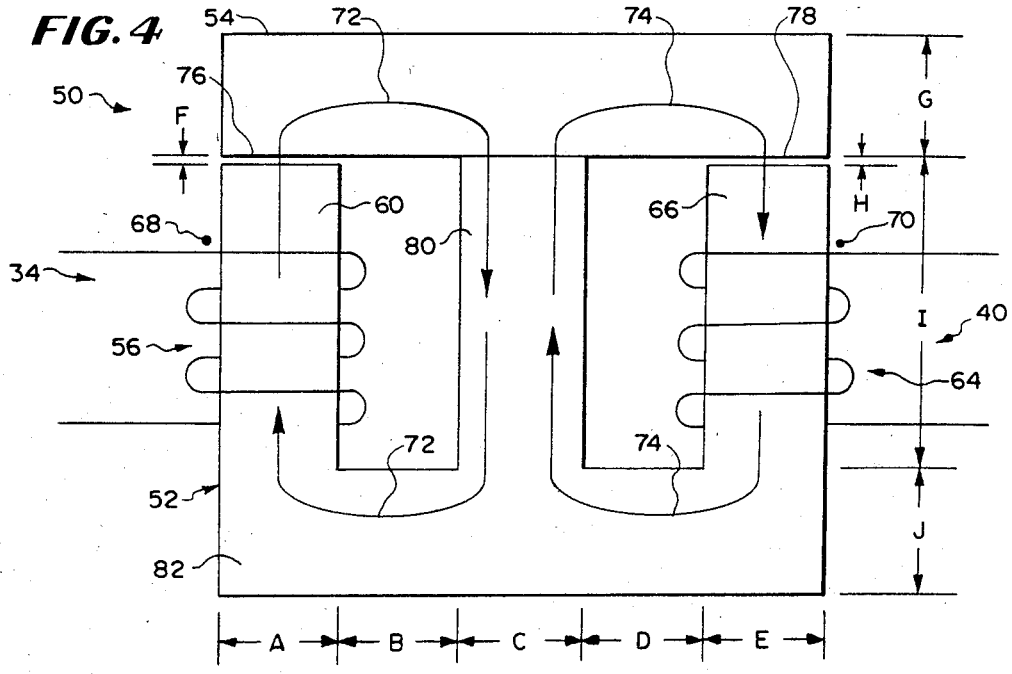
FIG. 4 is a diagram in elevation of the core structure and coils of the single ballast of the invention.

A ballast 50, seen in FIG. 4, comprises metal laminations assemblied as a stack to provide a core 52 that is "E" shaped or has three legs, and an "I" shaped end piece 54. A wire coil 56 is mounted on leg 60 of core 50, and a wire coil 64 is mounted on leg 66 of core 50. The respective polarity of the coils 56 and 64 is indicated by the dots 68 and 70 and the resulting magnetic flux flox induced by coils 56 and 64 is indicated respectively by arrows 72 and 74. An air gap 76 is maintained between the leg 60 and end piece 54 having a dimension F and an air gap 78 is maintained between leg 66 and end piece 54 having a dimension H.

In operation, current flowing through coil 56 alone, such as in the LOW mode, causes magnetic flux represented by arrows 72 to flow through legs 60 and 80, base 82 and end piece 54 in a clockwise direction. Air gap 76 controls the impedance of coil 56 whereby to realize a desired high reactance for the coil.

In the MED mode, current flows only through coil 64, causing magnetic flux represented by arrows 74 to flow through legs 66 and 80, base 82, and end piece 54 in a clockwise direction. Air gap 78 controls the impedance of coil 64 whereby to realize the desired low reactance for the coil.

In the HIGH mode, current flows through the coils 56 and 64, causing appreciable magnet flux in the legs 60 and 66, base 82 and end piece 54, but small magnetic flux in shared, common leg 80. Effectively, the two opposing fluxes in the leg 80 cancel one another. Because of this cancellation effect, the center leg 80 can be dimensioned to be no larger than either of legs 60 and 66, or slightly smaller to adjust the reactances effected in the coils. Thus, the cross-sectional areas of legs 60, 66 and 80, base 82 and end piece 54 are substantially equal. Alternatively, the cross-sectional area of leg 80 can be smaller than the other areas.

Air gap 78 effectively blocks magnetic flux flow through leg 66 when only coil 56 is energized, preventing the thereby induced flux from affecting coil 64. Air gap 76 effectively blocks magnetic flux flow through leg 60 when only coil 64 is energized, preventing the thereby induced flux from affecting coil 56.

Ballast 50 thus provides a unitary ballast means having two coils on a common magnetic core. The magnetic fluxes produced by currents flowing through the coils are independent of one another so that the coils present reactances that are independent of one another in a single ballast.

Ballast 50 thus can be connected into the devices 10, 11 and 13, to replace the two separate ballast means or chokes 34 and 40, 34' and 40', and 40''. This is done by connecting the terminals of coil 56 between pin 16 and filament 26 and by connecting the terminals of coil 64 between ring 18 and filament 26. The advantage of the dual choke system, such as independent current limiting in the LOW and MED modes, thus, is achieved in a single ballast apparatus.

Applicants are unaware of any drawing symbol that properly indicates both that coils 56 and 64 are mounted on a single magnetic core structure and that currents flowing through coils 56 and 64 operate or are limited independently of one another. Thus, the core and coil structure of ballast 50 is shown in FIGS. 5, 6 and 7 instead of the same being indicated symbolically.

Figure 5:
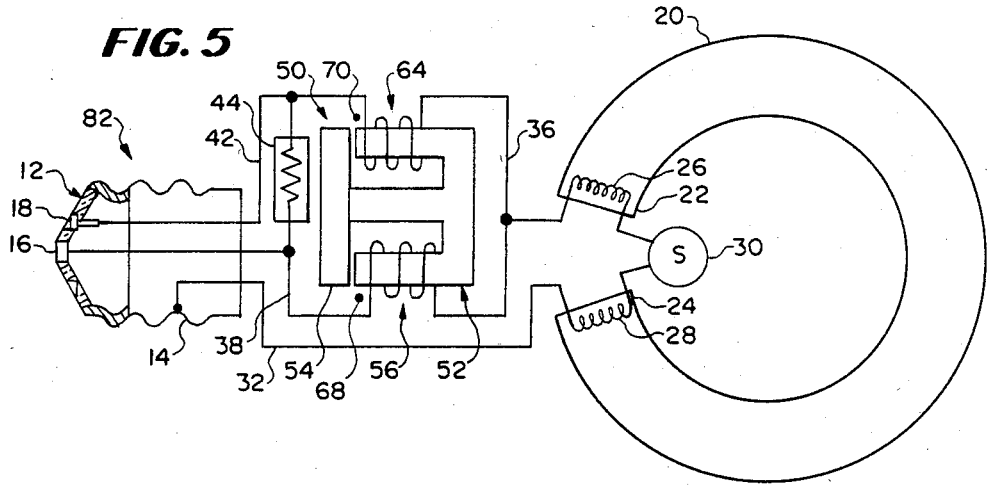
FIG. 5 is a schematic diagram illustrating one embodiment of a single ballast device of the invention.
Figure 6:
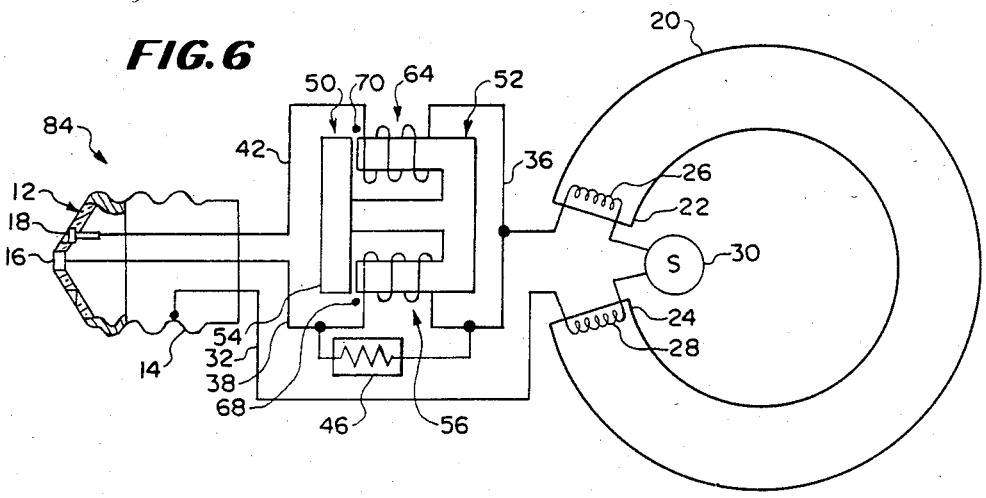
FIG. 6 is a schematic diagram illustrating a second embodiment of the single ballast device of the invention.
Figure 7:
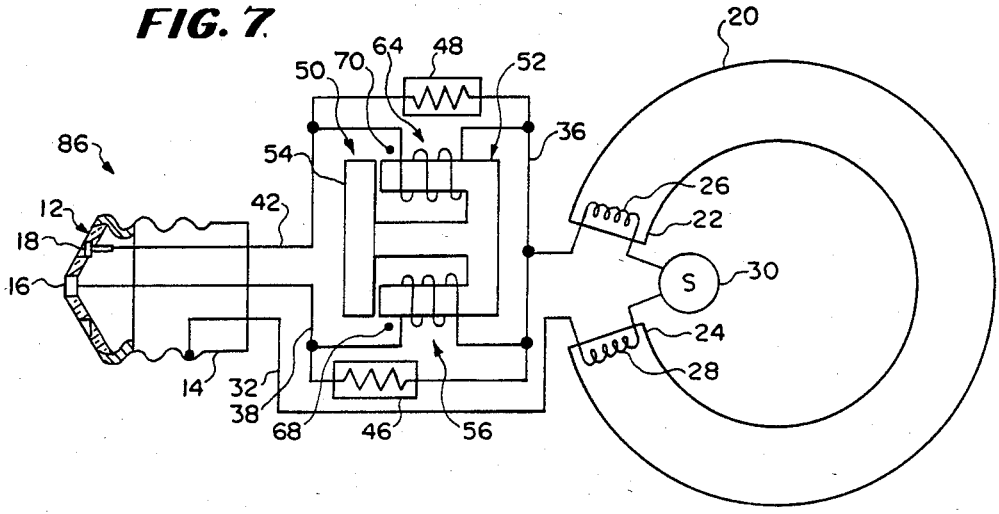
FIG. 7 is a schematic diagram illustrating a third embodiment of the single ballast device of the invention.

The operation of the devices 82, 84 and 86 in FIGS. 5, 6 and 7 is the same as the operation of devices 10, 11 and 13 of FIGS. 1, 2 and 8, respectively. The operation of devices 82, 84 and 86, therefore, will not be repeated.

In the preferred embodiment, it is contemplated that the widths of the legs 60, 80 and 66, the base 82 and end piece 54 will be about 5/16ths of an inch and will have a stack height of laminations of $\frac{5}{8}$ of an inch. The air gaps 76 and 78 and coil turns can then be selected to obtain the desired reactance and current values.

A circuit of FIG. 5 as described was constructed and operated utilizing the thermistor 44, as described, and a 22 watt Circline-type lamp. The specifications of ballast 50 were:

Coil 56-1620 turns of #30 AWG aluminum magnet wire wound on a plastic bobbin Coil 62-1500 turns of #30 AWG copper magnet wire wound on a plastic bobbin Lamination stack height of structure 50$\frac{5}{8}$ of an inch.

Core 52 and end piece 54 dimensions, in inches:

| | |
|---|---|
| A | 5/16 |
| B | 5/16 |
| C | 5/16 |
| D | $\frac{5}{8}$ |
| E | 5/16 |
| F | .007 |
| G | 5/16 |
| H | .013 |
| I | 15/16 |
| J | 5/16 |

The reason for the different D dimension was that a commercially available set of laminations having a C dimension of $\frac{5}{8}$ was cut in half to obtain the desired 5/16 dimension for center leg 80. This resulted in 5/16 being added to the 5/16 D dimension of the commercially available laminations. For purposes of the example, the indicated D dimension does not affect the magnetic structure of the invention.

With the components so valued and dimension, the circuit of FIG. 1 was operated through all three modes. Test data was obtained as follows (all modes are A.C.):

| | MODE | | |
|---|---|---|---|
| | LOW | MED | HIGH |
| INPUT VOLTAGE | 120 | 120 | 120 |
| INPUT CURRENT (AMPERES) | 0.104 | 0.241 | 0.397 |
| INPUT WATTAGE | 7.1 | 18.2 | 27.1 |
| LAMP VOLTAGE | 72 | 65 | 60 |
| LAMP WATTAGE | 6.2 | 13.0 | 19.3 |

Modifications and variations of the invention are possible in light of the above teachings. Dimensions and values other than those specified can be used within the scope of the invention. The general requirements for the passive circuit element have been described. It is to be understood, then, that within the scope of the appended claims, the invention can be practiced otherwise than as specifically described.

We claim:

1. A multiple level gas discharge lamp starting and operating system capable of producing three different levels of light, respectively, from a preheatable cathode fluorescent lamp, said fluorescent lamp including a starter means connected in series between two cathode filaments, said starter means providing a closed circuit during the preheating of the cathode, said system suitable for operation at line voltage when said system is energized in one of a LOW, MED or HIGH mode from a three-way incandescent lamp socket connected to an A.C. source of power, comprising:

A. an incandescent lamp three-way base for connection to said socket;

B. ballast means connecting the fluorescent lamp to said base and having at least one first reactor connected exclusively to carry operating current to said lamp in one of said LOW and MED modes, said first reactor having a value selected to limit the operating current of said one mode to a value below the starting current level required for starting the lamp;

C. passive circuit element means connected between said lamp and base and in parallel operating relation to at least said first reactor for switching a portion of the lamp starting current to by-pass said first reactor for a period sufficient to enable starting said lamp at the beginning of said one mode, and thereafter, switching operating current of said mode through only said first reactor; and D. means for directing the portion of the lamp starting current passing through said passive circuit element means in said by-pass condition through the cathode filament and starter means of said lamp in series to provide current sufficient to preheat the cathode and start the lamp.

2. The system of claim 1 in which said passive circuit element means is a positive temperature coefficient resistor.

3. The system of claim 1 in which said ballast menas includes a second reactor connected between said lamp and said base and exclusively carrying lamp operating current in the other of said LOW and MED modes, said passive circuit element means operable to switch said portion of the starting current for the lamp through said second reactor.

4. The system of claim 3 in which said passive circuit means is connected across the ballast means electrical terminals that are related to said first and second reactors and that are connected to said base.

5. The system of claim 4 in which said passive circuit element means is a positive temperature coefficient resistor.

6. The system of claim 1 in which said passive circuit element means includes a passive circuit element in parallel with said first reactor and operates to switch said portion of the starting current for the lamp through only said passive circuit element.

7. The system of claim 6 in which said ballast means includes a first choke presenting said first reactor.

8. The system of claim 6 in which said ballast means includes a ballast having one magnetic core structure mounting two coils thereon and one of said coils presenting said first reactor.

9. The system of claim 1 in which said ballast means includes a second reactor connected between said lamp and base, and exclusively carrying lamp operating circuit current in the other of said LOW and MED modes, the second reactor having a value selected to limit the operating current of said other mode to a value below the starting current level required for starting the lamp, said passive circuit element means connected in parallel operating relation to said second reactor for switching a portion of the lamp starting current to by-pass said second reactor for a period sufficient to enable starting said lamp at the beginning of said other mode, and, thereafter, switching operating current of said one mode through only said second reactor.

10. The system of claim 9 in which said passive circuit element means includes two passive circuit elements, each connected in parallel with one of said first and second reactors.

11. A multiple level, gas discharge lamp starting and operating system capable of producing three different levels of light, respectively, when said system is energized in one of a LOW, MED or HIGH mode from a three-way incandescent lamp socket connected to an A.C. source of power comprising:

A. a three way incandeescent lamp base adapted to mate with said socket and having a shell, a pin and a ring, electrical power being supplied across said shell and pin in the LOW mode, across said shell and ring in the MED mode and across said shell and the combination of said pin and ring in the HIGH mode;

B. a fluorescent lamp suitable for operation at line voltage having a preheatable filament in each of its two ends, the filaments being coupled together in series by a starter means providing a closed circuit for a time following the commencement of power being applied thereto, a first one of the filaments being directly connected to said shell;

C. ballast means having first and second reactors, the first reactor being connected between said second filament and said pin exclusively to carry operating current to the lamp in the LOW mode, the second reactor being connected between said second filament and said ring exclusively to carry operating current to the lamp in the MED mode, the reactance value of at least one of said first and second reactors selected to limit the related mode lamp operating current passing therethrough to a value below the starting current level required for starting the lamp;

D. passive circuit element means connected between said second second filament and base and in parallel operating relation to said one reactor for switching a portion of the lamp starting current to by-pass said one reactor for a period sufficient to enable starting said lamp at the beginning of the mode related to said one reactor, and, thereafter, switching operating current through only said one reactor; and E. means for directing the portion of the lamp starting current passing through said passive circuit element means in said by-pass condition through said filaments and said starter means in series to provide current sufficient to preheat said filaments for starting of said lamp.

12. The system of claim 11 in which said passive circuit element means is a positive temperature coefficient resistor.

13. The system of claim 11 in which said passive circuit element means switch said portion of the starting current for the lamp through said second reactor.

14. The system of claim 13 in which said passive circuit element means is connected across the ballast means electrical terminals that are related to said first and second reactors and that are connected to said base.

15. The system of claim 11 in which said passive circuit element means includes a passive circuit element connected in parallel with said one reactor, and operating to switch said portion of the starting current through only said passive circuit element.

16. The system of claim 15 in which said ballast means includes a magnetic core structure mounting two coils, one coil presenting the first reactor and the other coil presenting the second reactor.

17. The system of claim 11 in which both reactors have values selected to limit their related mode lamp operating current passing therethrough to values below the starting current level required for starting the lamp, said passive circuit element means being connected in parallel operating relation to said reactors for switching a portion of the lamp starting current to by-pass the appropriate reactor for a period sufficient to enable starting said lamp at the beginning of the mode related to the appropriate reactor, and, thereafter, switching operating current through only the appropriate reactor.

18. The system of claim 17 in which said passive circuit element means includes two passive circuit elements, each connected in parallel with one of said first and second reactors.

19. The system of claim 18 in which said ballast means includes a magnetic core structure mounting two coils, one coil presenting the first reactor and the other coil presenting the second reactor.

20. A ballast circuit for starting and operating a preheatable cathode fluorescent lamp suitable for operation at line voltage in one of a LOW, MED and HIGH mode from a three-way incandescent lamp socket and base connected to a source of A.C. electrical power, said fluorescent lamp including a starter means connected in series between two cathode filaments, said starter means providing a closed circuit during the preheating of the cathode, said circuit comprising:

A. ballast means adapted to connect the fluorescent lamp to said base and having at least one first reactor adapted exclusively to carry operating current to said lamp in one of said LOW and MED modes, said first reactor having a value selected to limit the operating current of said one mode to a value below the starting current level required for starting the lamp;

B. passive circuit element means connected in parallel operating relation to at least said first reactor for switching a portion of the lamp starting current to by-pass said first reactor for a period sufficient to enable starting said lamp at the beginning of said one mode, and, thereafter, switching operating current of said one mode through only said first reactance; and C. means for directing the portion of the lamp starting current passing through said passive circuit element means in said by-pass condition through the cathode filaments and starter means of the lamp in series to provide current sufficient to preheat the cathode and start the lamp.

21. The circuit of claim 20 in which said passive circuit element means is a positive temperature coefficient resistor.

22. The circuit of claim 20 in which said ballast means includes a second reactor adapted to be electrically connected between said base and lamp and exclusively coupling the required operating current for the lamp in the other of said LOW and MED modes from the base, said passive circuit element means operable to switch said portion of starting current for the lamp through said second reactor.

23. The circuit of claim 22 in which said passive circuit element means is connected across the ballast means terminals that are related to said first and second reactors and that are adapted to be connected to said base.

24. The circuit of claim 23 in which said ballast means includes a first choke presenting said first reactor and a second choke presenting said second reactor.

25. The circuit of claim 23 in which said ballast means includes a ballast having one magnetic core structure mounting two coils thereon, one coil presenting said first reactor and said the other coil presenting said second reactor.

26. The circuit of claim 20 in which said passive circuit element means includes a passive circuit element connected in parallel with said first reactor and operates to switch said portion of the starting current for the lamp through only said passive circuit element.

27. The circuit of claim 26 in which said ballast means includes a first choke presenting said first reactor.

28. The circuit of claim 26 in which said ballast means includes a ballast having one magnetic core structure mounting two coils thereon, and one of said coils presenting said first reactor.

29. The circuit of claim 20 in which said ballast means includes a second reactance adapated to be connected between said lamp and base, and adapted exclusively to carry lamp operating current in the other of said LOW and MED modes, the second reactor having a value selected to limit the operating current of said mode to a value below the starting current level required for starting the lamp, said passive circuit element means connected in parallel operating relation to said second reactor for switching a portion of the lamp starting current to by-pass said second reactor for a period sufficient to enable starting said lamp at the beginning of said other mode, and, thereafter, switching operating current of said one mode through only said second reactor.

30. The circuit of claim 29 in which said passive circuit element means includes two passive circuit elements, each connected in parallel with one of said first and second reactors.

31. The circuit of claim 30 in which said ballast means includes a first choke presenting said first reactor and a second choke presenting said second reactor.

32. The circuit of claim 30 in which said ballast means includes a ballast having one magnetic core structure mounting two coils thereon, one coil presenting said first reactor and the other coil presenting said second reactor.

33. A ballast circuit for starting and operating a preheatable cathode fluorescent lamp suitable for operation at line voltages in one of a LOW, MED and HIGH mode from a three-way incandescent lamp socket and base, which has a shell, pin and ring, connected to a source of A.C. electrical power, the power being supplied across the shell and pin in the low mode, across the shell and ring in the MED mode, and across the shell and the combination of the pin and ring in the HIGH mode, the lamp having two preheatable cathode filaments coupled together in series by a starter means providing a closed circuit during the preheating of the filaments, and a first of the filaments being directly connected to the shell, the circuit comprising:

A. ballast means having first and second reactors, the first reactor adapted to be connected between said second filament and said pin exclusively to carry operating current to the lamp in the LOW mode, the second reactor adapted to be connected between said second filament and said ring exclusively to carry operating current to the lamp in the MED mode, the reactance value of at least one of said first and second reactors selected to limit the related mode lamp operating current passing therethrough to a value below the starting current level required for starting the lamp;

B. passive circuit element means connected between said second filament and base and in parallel operating relation to said one reactor for switching a portion of the lamp starting current to by-pass said one reactor for a period sufficient to enable starting said lamp at the beginning of the mode related to said one reactor, and, thereafter, switching operating current through only said one reactor; and C. means for directing the portion of the lamp starting current passing through said passive circuit element means in said by-pass condition through said filaments and said starter means in series to provide current sufficient to preheat said filaments starting of said lamp.

34. The circuit of claim 33 in which said passive circuit element means is a positive temperature coefficient thermistor.

35. The circuit of claim 33 in which said passive circuit element means switch said portion of the starting current for the lamp through said second reactor.

36. The circuit of claim 35 in which said passive circuit element means is connected across the ballast means electrical terminals that are related to said first and second reactors and that are connected to said base.

37. The circuit of claim 33 in which said passive circuit element means includes a passive circuit element connected in parallel with said one reactor, and operating to switch said portion of the starting current through only said passive circuit element.

38. The circuit of claim 37 in which said ballast means includes a magnetic core structure mounting two coils, one coil presenting the first reactor and the other coil presenting the second reactor.

39. The circuit of claim 33 in which both reactors have values selected to limit their related mode lamp operating currents passing therethrough to values below the starting current level required for starting the lamp, said passive circuit element means being connected in parallel operating relation to said reactors for switching a portion of the lamp starting current to by-pass the appropriate reactors for a period sufficient to enable starting said lamp at the beginning of the mode related to the appropriate reactor, and, thereafter, switching operating current through only the appropriate reactor.

40. The circuit of claim 39 in which said passive circuit element means includes two passive circuit elements, each connected in parallel with one of said first and second reactors.

41. The circuit of claim 10 in which said ballast means includes a magnetic core structure mounting two coils, one coil presenting the first reactor and the other coil presenting the second reactor.

42. In a ballast circuit for starting and operating a preheatable cathode fluorescent lamp suitable for operation at line voltages at multiple levels of light from a source of A.C. electrical power, said circuit including a fluorescent lamp and a three-way terminal base for connecting the lamp into a three-way incandescent lamp socket supplied with power from the source, the multiple levels of light being any one of a LOW, MED and HIGH mode, the invention comprising:

ballast means adapted to be connected between said base and lamp and including:

i. a magnetic core having a pair of outer legs and a center leg therebetween joined together by a core base;

ii. an end piece arranged across the ends of said three legs opposite said core base; and iii. a coil of wire mounted on each outer leg, each coil having terminals adapted to be connected to the terminal base and to the lamp, the core and endpiece providing a path for the magnetic flux induced by each coil to be in a loop through the respective outer leg and through the center leg;

iv. the core, end piece and one of the coils being arranged to limit the operating current of the lamp that can pass through said one coil in one of the LOW and MED modes to a value less than the starting current required to start said lamp.

43. The invention of claim 42 in which the cross-sectional area of the center leg is not greater than that of either outer leg.

44. The invention of claim 42 in which the cross sectional area of the center leg is equal to that of the outer legs.

45. The invention of claim 42 including passive circuit element means connected in parallel operating relation with said ballast means for switching a portion of the lamp starting current to by-pass said one coil for a period sufficient to enable starting of said lamp at the beginning of said one mode, and thereafter, switching operating current of said one mode through only said one coil.

46. The invention of claim 45 in which the passive circuit element means switch current in response to resistive heating thereof resulting from current flowing therethrough.

47. The invention of claim 46 in which said passive circuit element means is a positive temperature coefficient resistor.

48. The invention of claim 42 in which said passive circuit element means is connected to the terminals of said coils adapted to be connected to said terminal base.

49. The invention of claim 42 in which said passive circuit element means is connected across the terminals of said one coil.

50. The invention of claim 42 in which said core, endpiece and other coil are arranged to limit the operating current of the lamp that can pass through said outer coil in the other of the LOW and MED modes to a value less than the starting current required to start said lamp; and said passive circuit element means including two passive circuit elements, one connected across the terminals of each coil.

51. The invention of claim 42 in which the coils are arranged so that the magnetic flux in the path loops through the common center leg oppose one another.

52. A multiple level gas discharge lamp starting and operating system capable of producing three different levels of light, respectively, from a preheatable cathode fluorescent lamp suitable for operation at line voltage when said system is energized in one of a LOW, MED or HIGH mode from a three-way incandescent lamp socket connected to an A.C. source of power, comprising:

A. an incandescent lamp three-way base for connection to said socket;

B. ballast means connecting the fluorescent lamp to said base and having at least one first reactor connected exclusively to carry operating current to said lamp in one of said LOW and MED modes, said first reactor having a value selected to limit the operating current of said one mode to a value below the starting current level required for starting the lamp; and C. passive circuit element means connected between said lamp and base and in parallel operating relation to at least said first reactor for switching a portion of the lamp starting current to by-pass said first reactor for a period sufficient to enable starting said lamp at the beinning of said one mode, and thereafter, switching operating current of said one mode through only said first reactor, wherein said ballast means includes a second reactor connected between said lamp and said base and exclusively carrying lamp operating current in the other of said LOW or MED modes, said passive circuit element means operable to switch said portion of the starting current for the lamp through said second reactor;

said passive circuit means is connected across the ballast means electrical terminals that are related to said first and second reactors and that are connected to said base;

said passive circuit element means is a positive temperature coefficient resistor; and said ballast means includes a first choke presenting said first reactor and a second choke presenting said second reactor.

53. A multiple level gas discharge lamp starting and operating system capable of producing three different levels of light, respectively, from a preheatable cathode fluorescent lamp suitable for operation at line voltage when said system is energized in one of a LOW, MED or HIGH mode from a three-way incandescent lamp socket connected to an A.C. source of power, comprising:

A. an incandescent lamp three-way base for connection to said socket;

B. ballast means connecting the fluorescent lamp to said base and having at least one first reactor connected exclusively to carry operating current to said lamp in one of said LOW and MED modes, said first reactor having a value selected to limit the operating current of said one mode to a value below the starting current level required for starting the lamp; and C. passive circuit element means connected between said lamp and base and in parallel operating relation to at least said first reactor for switching a portion of the lamp starting current to by-pass said first reactor for a period sufficient to enable starting said lamp at the beginning of said one mode, and thereafter, switching operating current of said one mode through only said first reactor, wherein said ballast means includes a second reactor connected between said lamp and said base and exclusively carrying lamp operating current in the other of said LOW and MED modes, said passive circuit element means operable to switch said portion of the starting current for the lamp through said second reactor;

said passive circuit means is connected across the ballast means electrical terminals that are related to said first and second reactors and that are connected to said base;

said passive circuit element means is a positive temperature coefficient resistor; and said ballast means includes a ballast having one magnetic core structure mounting two coils thereon, one coil presenting said first reactor and said other coil presenting said second reactor.

54. A multiple level gas discharge lamp starting and operating system capable of producing three different levels of light, respectively, from a preheatable cathode fluorescent lamp suitable for operation at line voltage when said system is energized in one of a LOW, MED or HIGH mode from a three-way incandescent lamp socket connected to an A.C. source of power, comprising:

A. an incandescent lamp three-way base for connection to said socket;

B. ballast means connecting the fluorescent lamp to said base and having at least one first reactor connected exclusively to carry operating current to said lamp in one of said LOW and MED modes, said first reactor having a value selected to limit the operating current of said one mode to a value below the starting current level required for starting the lamp; and C. passive circuit element means connected between said lamp and base and in parallel operating relation to at least said first reactor for switching a portion of the lamp starting current to by-pass said first reactor for a period sufficient to enable starting said lamp at the beginning of said one mode, and thereafter, switching operating current of said mode through only said first reactor; wherein said ballast means includes a second reactor connected between said lamp and base, and exclusively carrying lamp operating circuit current in the other of said LOW and MED modes, the second reactor having a value selected to limit the operating current of said other mode to a value below the starting current level required for starting the lamp, said passive circuit element means connected in parallel operating relation to said second reactor for switching a portion of the lamp starting current to by-pass said second reactor for a period sufficient to enable starting said lamp at the beginning of said other mode, and, thereafter, switching operating current of said one mode through only said second reactor;

said passive circuit element means includes two passive circuit elements, each connected in parallel with one of said first and second reactors; and said ballast means includes a first choke presenting said first reactor and a second choke presenting said second reactor.

55. A multiple level gas discharge lamp starting and operating system capable of producing three different levels of light, respectively, from a preheatable cathode fluorescent lamp suitable for operation at line voltage when said system is energized in one of a LOW, MED or HIGH mode from a three-way incandescent lamp socket connected to an A.C. source of power, comprising:

A. an incandescent lamp three-way base for connection to said socket;

B. ballast means connecting the fluorescent lamp to said base and having at least one first reactor connected exclusively to carry operating current to said lamp in one of said LOW and MED modes, said first reactor having a value selected to limit the operating current of said one mode to a value below the starting current level required for starting the lamp; and C. passive circuit element means connected between said lamp and base and in parallel operating relation to at least said first reactor for switching a portion of the lamp starting current to by-pass said first reactor for a period sufficient to enable starting said lamp at the beginning of said one mode, and thereafter, swtiching operating current of said mode through only said first reactor; wherein said ballast means includes a second reactor connected between said lamp and base, and exclusively carrying lamp operating circuit current in the other of said LOW and MED modes, the second reactor having a value selected to limit the operating current of said other mode to a value below the starting current level required for starting the lamp, said passive circuit element means connected in parallel operating relation to said second reactor for switching a portion of the lamp starting current to by-pass said second reactor for a period sufficient to enable starting said lamp at the beginning of said other mode, and, thereafter, switching operating current of said one mode through only said second reactor;

said passive circuit element means includes two passive circuit elements, each connected in parallel with one of said first and second reactors; and said ballast means includes a ballast having one magnetic core structure mounting two coils thereon, one coil persenting said first reactor and the other coil presenting said second reactor.

56. A multiple level, gas discharge lamp starting and operating system capable of producing three different levels of light, respectively, when said system is energized in one of a LOW, MED or HIGH mode from a three-way incandescent lamp socket connected to an A.C. source of power comprising:

A. a three way incandescent lamp base adapted to mate with said socket and having a shell, a pin and a ring, electrical power being supplied across said shell and pin in the LOW mode, across said shell and ring in the MED mode and across said shell and the combination of said pin and ring in the HIGH mode;

B. a fluorescent lamp suitable for operation at line voltage having a preheatable filament in each of its two ends, the filaments being coupled together in starting relationship for a time following the commencement of power being applied thereto, a first one of the filaments being directly connected to said shell;

C. ballast means having first and second reactors, the first reactor being connected between said second filament and said pin exclusively to carry operating current to the lamp in the LOW mode, the second reactor being connected between said second filament and said ring exclusively to carry operating current to the lamp in the MED mode, the reactance value of at least one of said first and second reactors selected to limit the related mode lamp operating current passing therethrough to a value below the starting current level required for starting the lamp; and D. passive circuit element means connected between said second second filament and base and in parallel operating relation to said one reactor for switching a portion of the lamp starting current to by-pass said one reactor for a period sufficient to enable starting said lamp at the beginning of the mode related to said one reactor, and, thereafter, switching operating current through only said one reactor; wherein said passive circuit element means includes a passive circuit element connected in parallel with said one reactor, and operating to switch said portion of the starting current through only said passive circuit element; and said ballast means includes a first choke presenting said first reactor and a second choke presenting said second reactor.

57. A multiple level, gas discharge lamp starting and operating system capable of producing three different levels of light, respectively, when said system is energized in one of a LOW, MED or HIGH mode from a three-way incandescent lamp socket connected to an A.C. source of power comprising:

A. a three way incandeescent lamp base adapted to mate with said socket and having a shell, a pin and a ring, electrical power being supplied across said shell and pin in the LOW mode, across said shell and ring in the MED mode and across said shell and the combination of said pin and ring in the HIGH mode;

B. a fluorescent lamp suitable for operation at line voltage having a preheatable filament in each of its two ends, the filaments being coupled together in starting relationship for a time following the commencement of power being applied thereto, a first one of the filaments being directly connected to said shell;

C. ballast means having first and second reactors, the first reactor being connected between said second filament and said pin exclusively to carry operating current to the lamp in the LOW mode, the second reactor being connected between said second filament and said ring exclusively to carry operating current to the lamp in the MED mode, the reactance value of at least one of said first and second reactors selected to limit the related mode lamp operating current passing therethrough to a value below the starting current level required for starting the lamp; and D. passive circuit element means connected between said second filament and base and in parallel operating relation to said one reactor for switching a portion of the lamp starting current to by-pass said one reactor for a period sufficient to enable starting said lamp at the beginning of the mode related to said one reactor, and, thereafter, switching operating current through only said one reactor; wherein both reactors have values selected to limit their related mode lamp operating currents passing therethrough to values below the starting current level required for starting the lamp, said passive circuit element means being connected in parallel operating relation to said reactors for switching a portion of the lamp starting current to by-pass the appropriate reactor for a period sufficient to enable starting said lamp at the beginning of the mode related to the appropriate reactor, and, thereafter, switching operating current through only the appropriate reactor;

said passive circuit element means includes two passive circuit elements, each connected in parallel with one of said first and second reactors; and said ballast means includes a first choke presenting said first reactor and a second choke presenting said second reactor.

58. A ballast circuit for starting and operating a preheatable cathode fluorescent lamp suitable for operation at line voltages in one of a LOW, MED and HIGH mode from a three-way incandescent lamp socket and base, which has a shell, pin and ring, connected to a source of A.C. electrical power, the power being supplied across the shell and pin in the low mode, across the shell and ring in the MED mode, and across the shell and the combination of the pin and ring in the HIGH mode, the lamp having two preheatable cathode filaments and a first of the filaments being directly connected to the shell, the circuit comprising:

A. ballast means having first and second reactors, the first reactor adapted to be connected between said second filament and said pin exclusively to carry operating current to the lamp in the LOW mode, the second reactor adapted to be connected between said second filament and said ring exclusively to carry operating current to the lamp in the MED mode, the reactance value of at least one of said first and second reactors selected to limit the related mode lamp operating current passing therethrough to a value below the starting current level required for starting the lamp; and B. passive circuit element means connected between said second filament and base and in parallel operating relation to said one reactor for switching a portion of the lamp starting current to by-pass said one reactor for a period sufficient to enable starting said lamp at the beginning of the mode related to said one reactor, and, thereafter, switching operating current through only said one reactor; wherein said passive circuit element means includes a passive circuit element connected in parallel with said one reactor and operating to switch said portion of the starting current through only said passive circuit element; and said ballast means includes a first choke presenting said first reactor and a second choke presenting said second reactor.

59. A ballast circuit for starting and operating a preheatable cathode fluorescent lamp suitable for operation at line voltages in one of a LOW, MED and HIGH mode from a three-way incandescent lamp socket and base, which has a shell, pin and ring, connected to a source of A.C. electrical power, the power being supplied across the shell and pin in the low mode, across the shell and ring in the MED mode, and across the shell and the combination of the pin and ring in the HIGH mode, the lamp having two preheatable cathode filaments and a first of the filaments being directly connected to the shell, the circuit comprising:

A. ballast means having first and second reactors, the first reactor adapted to be connected between said second filament and said pin exclusively to carry operating current to the lamp in the LOW mode, the second reactor adapted to be connected between said second filament and said ring exclusively to carry operating current to the lamp in the MED mode, the reactance value of at least one of said first and second reactors selected to limit the related mode lamp operating current passing therethrough to a value below the starting current level required for starting the lamp; and B. passive circuit element means connected between said second filament and base and in parallel operating relation to said one reactor for switching a portion of the lamp starting current to by-pass said one reactor for a period sufficient to enable starting said lamp at the beginning of the mode related to said one reactor, and, thereafter, switching operating current through only said one reactor; wherein both reactors have values selected to limit their related mode lamp operating currents passing therethrough to values below the starting current level required for starting the lamp, said passive circuit element means being connected in parallel operating relation to said reactors for switching a portion of the lamp starting current to by-pass the appropriate reactors for a period sufficient to enable starting said lamp at the beginning of the mode related to the appropriate reactor, and, thereafter, switching operating current through only the appropriate reactor;

said passive circuit element means includes two passive circuit elements, each connected in parallel with one of said first and second reactors; and said ballast means includes a first choke presenting said first reactor and a second choke presenting said second reactor.

* * * * *

UNITED STATES PATENT AND TRADEMARK OFFICE

CERTIFICATE OF CORRECTION

PATENT NO. : 4,593,231

DATED : June 3, 1986

INVENTOR(S) : ROBERT WISBEY & JOSEPH DROHO

It is certified that error appears in the above-identified patent and that said Letters Patent are hereby corrected as shown below:

Column 1, line 32, "flurorescent" should be --Fluorescent--;

Column 7, line 47, "achieve" should be --achieved--;

Column 7, line 49, "operative" should be --operates--;

Column 8, line 28,"Mode" should be --mode--;

Column 9, line 18, "bi-mental" should be --bi-metal--;

Column 9, line 49, "F" should be --F--;

Column 9, line 51, "H" should be --H--;

Column 12, line 4, "menas" should be --means--;

Column 12, line 53, "incandeescent" should be --incandescent--;

Column 13, line 12, "second" (first occurrence) should be deleted;

Column 17, line 52, "benning" should be --beginning--;

Column 19, line 51, "swtiching" should be --switching--;

Column 20, line 6, "persenting" should be --presenting--;

Column 20, line 41, "second" (first occurrence) should be deleted;

UNITED STATES PATENT AND TRADEMARK OFFICE

CERTIFICATE OF CORRECTION

PATENT NO. : 4,593,231

DATED : June 3, 1986

INVENTOR(S) : ROBERT WISBEY & JOSEPH DROHO

It is certified that error appears in the above-identified patent and that said Letters Patent are hereby corrected as shown below:

Column 20, line 64, "incandeescent" should be --incandescent--;

Column 14, line 20, "reactance" should be --reactor--;

Column 14, line 62, "reactance adapated" should be --reactor adapted--.

Signed and Sealed this

*Sixteenth* Day of *September 1986*

[SEAL]

*Attest:*

*Attesting Officer*

DONALD J. QUIGG

*Commissioner of Patents and Trademarks*